United States Patent [19]

Fahrenschon

[11] 4,242,747

[45] Dec. 30, 1980

[54] ANALOG-DIGITAL CHRONOMETRIC DISPLAY

[75] Inventor: Kurt Fahrenschon, Kelkheim, Fed. Rep. of Germany

[73] Assignee: Braun AG, Frankfurt am Main, Fed. Rep. of Germany

[21] Appl. No.: 922,572

[22] Filed: Jul. 6, 1978

[30] Foreign Application Priority Data

Jul. 21, 1977 [DE] Fed. Rep. of Germany ..... 2732877

[51] Int. Cl.[3] ..... G04B 19/34

[52] U.S. Cl. ..... 368/242; 368/223; 368/84

[58] Field of Search ..... 58/23 R, 50 R, 127 R; 340/784, 765; 350/333, 336

[56] References Cited

U.S. PATENT DOCUMENTS

| | | | |
|---|---|---|---|
| 3,258,906 | 7/1966 | Demby | 58/50 R |
| 3,626,410 | 12/1971 | Dekoster | 58/23 R X |
| 3,756,013 | 9/1973 | Bergey et al. | 58/23 R X |
| 3,772,874 | 11/1973 | Lefkowitz | 58/50 R |
| 3,823,549 | 7/1974 | Feldman | 58/127 R X |
| 3,911,665 | 10/1975 | Van Berkum | 58/50 R |
| 3,958,409 | 5/1976 | Manber | 58/50 R |
| 3,959,963 | 6/1976 | Murrell | 58/127 R |
| 3,987,617 | 10/1976 | Slob | 58/50 R |
| 3,992,875 | 11/1976 | Kashio | 58/50 R |
| 4,077,032 | 2/1978 | Volkman | 58/50 R X |
| 4,081,953 | 4/1978 | Crutcher | 58/50 R |
| 4,095,405 | 6/1978 | Tanaka | 58/50 R X |

FOREIGN PATENT DOCUMENTS 2410527 9/1974 Fed. Rep. of Germany .

*Primary Examiner*—Ulysses Weldon
*Attorney, Agent, or Firm*—Karl F. Ross

[57] ABSTRACT

A chronometric indicator for a watch has concentric arrays of angularly equispaced electrodes and analog display segments. The electrodes are staggered relative to the display segments so that each electrode overlaps halves of two adjacent segments, so that by selective energization of the electrode and the segments any half can be optically activated. In addition a digital display is provided within the two annular arrays, with each digit segment of the display being connected to a respective analog segment. A common connection for this digital display can be energized simultaneously with any of the outer analog segments to cause the corresponding digit segment to glow. The overlapping arrays of electrodes and analog display segments are energized to indicate the hour and minute, and the digital display is energized to indicate the second.

9 Claims, 2 Drawing Figures

ANALOG-DIGITAL CHRONOMETRIC DISPLAY

FIELD OF THE INVENTION

The present invention relates to an electronic timepiece. More particularly this invention concerns an analog-digital indicator for such a timepiece.

BACKGROUND OF THE INVENTION

A substantial failing with the known electronic timepieces having so-called digital readouts is that they are not as easy to read as a standard timepiece having an analog readout constituted by the hour, minute and second hands. A person accustomed to reading a standard analog timepiece is not able to easily read the several digits of a normal electronic watch.

For this reason it is known to provide, as described in German patent publication No. 2,451,057, a timepiece with an at least partially analog display constituted by an array of angularly equispaced rods, normally numbering sixty, of which twelve have individually energizable separate inner parts. It is therefore possible sequentially to energize the inner parts in accordance with the hour and the outer parts in accordance with the minute, thereby giving an analog display that closely resembles the standard timepiece. Attempts to add a second indicator to this arrangement have proven so complex as to be completely impractical. Another disadvantage in this system, and in the comparable system described in German patent publication No. 2,410,527, is that the hour indication at least is relatively crude so that ascertaining the exact time is relatively difficult.

Another system is described in German patent publication No. 2,260,057 which uses an analog display of the hours and a digital display of the minutes and seconds. Such a system therefore contains a relatively complex binary/decimal converter, and requires 132 connections to the display or indicator so that the desired information can all be displayed. Such an indicator is therefore relatively expensive and has a correspondingly short service life.

OBJECTS OF THE INVENTION

It is therefore an object of the present invention to provide an improved indicator for a timepiece.

Another object is to provide such an indicator which is relatively simple, yet which furnishes an easy-to-understand display of at least the hour and minute in analog fashion.

SUMMARY OF THE INVENTION

These objects are attained in accordance with the instant invention in a chronometric indicator having an array of generally angularly equispaced electrodes each having a respective electrode connection and an array of generally angularly equispaced display segments each having a respective segment connection and each also having one half overlapping one respective electrode and another half overlapping another respective electrode. Thus each electrode overlaps halves of two adjacent analog display segments. Sequence means is connected to these connections for selectively energizing same and thereby activating the halves by simultaneous energization of the respective electrode and segment connections. When one electrode is energized simultaneously with one of the respective analog display segments the corresponding half will be optically activated, normally by glowing.

In accordance with this invention the electrodes and segments both number thirty and every other electrode is connected to an inner connection ring and the remaining electrodes are connected to an outer connection ring. Thus the entire display can operate to display the hour and minute accurately using only thirty-two connections, one to each display segment, one to the even electrodes and one to the odd electrodes.

According to this invention the display is particularly easy to read as a plurality of halves can be optically energized indicating the hour whereas a single half can be energized to indicate the minute. Although the sequencer will operate with at least two phases, in one of which it energizes the appropriate connections to indicate the hour and in the other of which it energizes the appropriate connections to indicate the minute, the phases follow each other so rapidly and the material, normally of liquid-crystal type, constituting the optically activatable segments will appear to glow continuously.

According to another important feature of this invention the above-described analog display is combined with a digital display having a plurality of digits each formed by a plurality of respective segments each connected to a respective analog segment. This multidigit display also has a common connection, so that by increasing the number of connections to the display by one it is possible also to display four digits in digital fashion. Such a digital display may indicate the second, date, elapsed time, or the like. The sequencer for this arrangement therefore will operate in three phases, in the third of which it energizes the common or buss connection for the multidigit display. This multidigit display can be provided within the annular analog display so that the resulting timepiece is extremely compact, yet easy to read due to the analog hour and minute display.

SPECIFIC DESCRIPTION

Figure 1:
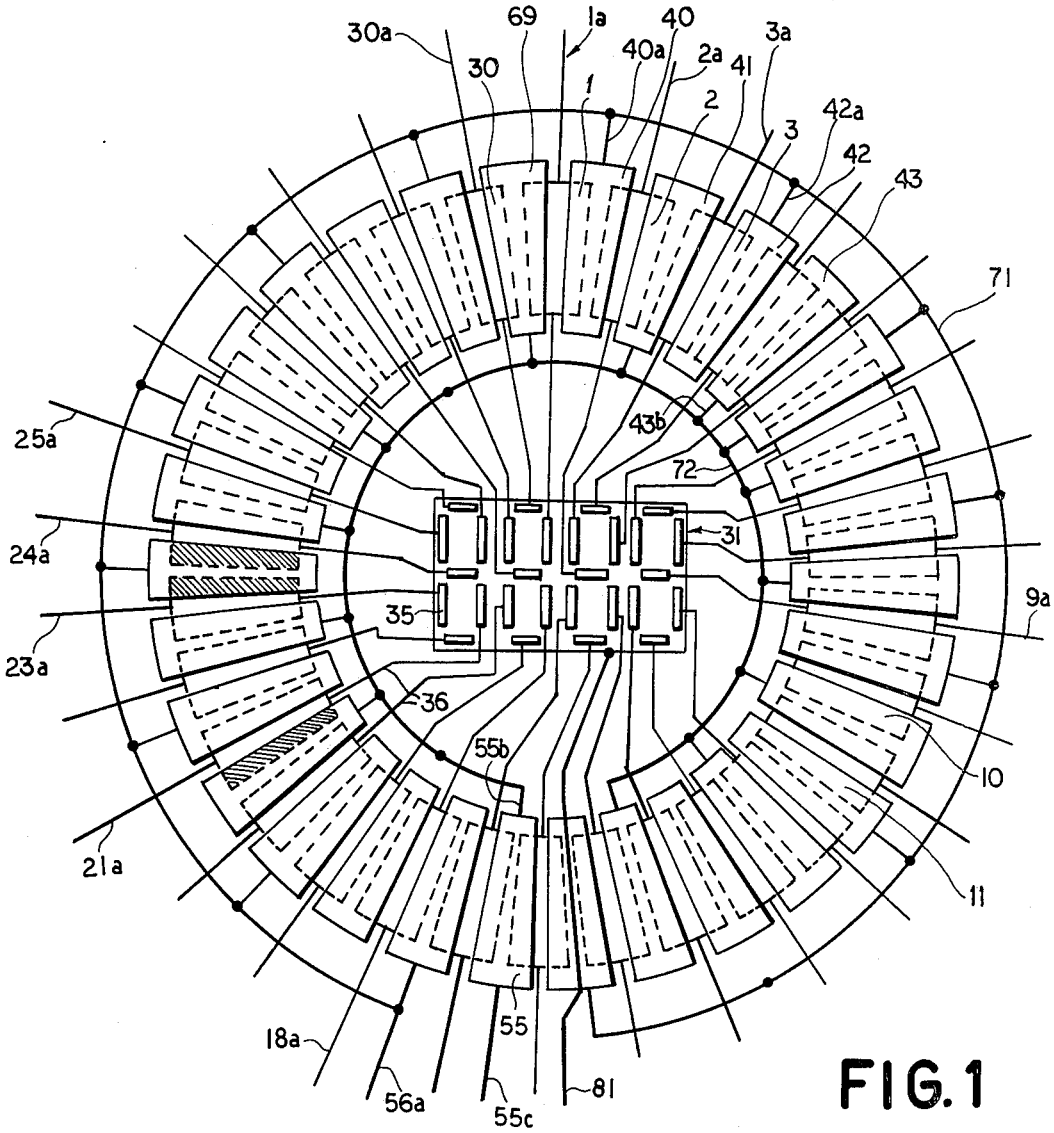
FIG. 1 is a plan view of the display according to this invention in enlarged scale.

As shown in FIG. 1 a display according to the instant invention comprises an annular array of thirty identical liquid-crystal bars or segments 1–30, having respective radially outwardly extending connections 1*a*–30*a*. Overlying this annular array of analog display segments 1–30 is an annular of thirty electrodes 40–69, each overlapping a portion, hereinafter referred to as a half although in reality substantially less than a geometric half, of two respective annular segments. Thus the electrode 40 overlaps a half of the segment 1 and a half of the segment 2, the electrode 41 half of the segment 2 and a half of the segment 3, and so on. The even-number electrodes 40, 42, 44 . . . are connected via respective electrode connections 40*a*, 42*a*, 44*a* . . . to an outer connection ring 71 connected in turn to a sequencer (FIG. 2) via the connection 56*a*. The odd-numbered electrodes 41, 43, 45 . . . have inwardly extending connections 41*b*, 43*b*, 45*b* . . . connected to an inner connection ring 72 that is connected via an outwardly extending connection 55*c* of the electrode 55 to the sequencer 33.

Within the arrays of electrodes and display segments is a four-digit display 31 whose four digits each have seven segments 35 connected via respective conductors 36 to respective ones of the annular segments 1–30. As there are only twenty-eight digit segments 35 but there are thirty analog display segments 1–30, two of these segments, namely the segments 10 and 11, remain unconnected to digit segments. In addition this digit display 31 also has a common or buss connection 81. With this system, therefore, any of the halves of the segments 1–30 or any of the segments 35 can be optically activated by energization of selected ones of the thirty-three connections to the display.

Figure 2:
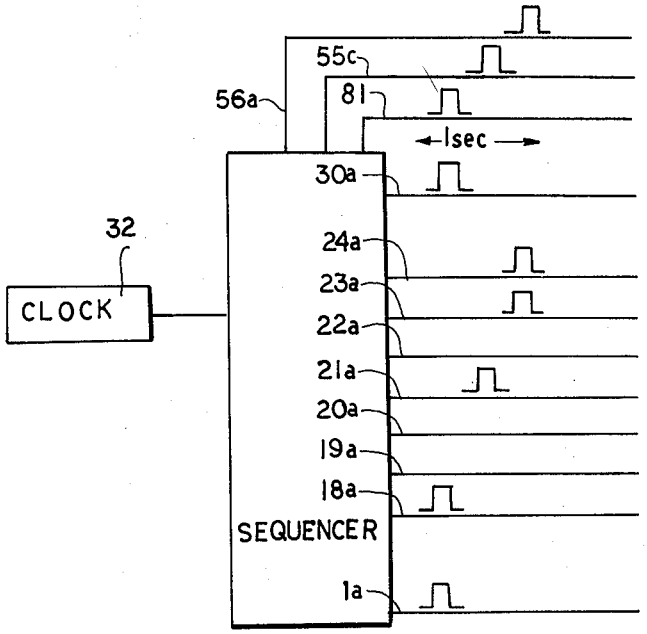
FIG. 2 is a schematic view of the operating circuit for the display of FIG. 1.

More particularly as shown in FIG. 2 a clock 32 is connected to the sequencer 34 which in turn is connected to the lines **1*a*–30*a*, 56*a*, 55*c*, and 81. To display a time of eight hours forty minutes and seven seconds the sequencer first generates a pulse on the lines 81, 1*a*, 18*a*, and 30*a* simultaneously. The electrical pulse applied to the segment 1 will cause no optical activation of this segment as neither the electrodes 40 or 69 is activated, but since the line 81 is activated the energization of the segments 35 forming the number 7 will glow. Thereafter the sequencer 33 will generate a pulse on the line 55*c* simultaneously with a pulse on the line 21*a*. This will cause the hatched half of segment 21 to glow as the corresponding segment 21 will be energized along with the electrode 59 connected via the ring 72 the line 55*c* to the sequencer 33. The hour will be indicated subsequently when a pulse is fed to the line 56*a* simultaneously with the lines 23*a* and 24*a*. Thus half of the segment 23 and half of the segment 24** will both glow, forming a relatively wide indication of the hour, and facilitating reading of the watch as the hour indication will be substantially wider than the minute indication.

It is within the scope of this invention to vary the above-described system, in particular in line with teachings of the commonly assigned and copending application 921,007 filed June 30, 1978. It will be within the scope of this invention to optically activate more or less of the segment halves to indicate the hours or minutes, if desired, as well as to use a different type of display at the center in place of the display 31. More particularly a more complex display assigning more segments to the digits, as for instance nine, could be used instead of the display 31. Alternately a display could be used that lies outside rather than within the annular arrays of electrodes and display segments.

I claim:

1. A chronometric indicator comprising:

an array of generally angularly equispaced electrodes each having a respective electrode connection;

an array of generally angularly equispaced analog display segments each having a respective segment connection and each having one half overlapping one respective electrode and another half overlapping another respective electrode; and means connected to said connections and operable in a first phase to energize two of said segment connections and one of said electrode connections to indicate the hour by activating two of said halves, and in a second phase to energize a single one of said segment connections and a single one of said electrode connections to indicate the minute by activating one of said halves.

2. The indicator defined in claim 1 wherein said electrodes number thirty and said segments also number thirty.

3. The indicator defined in claim 2 wherein said arrays are concentric.

4. The indicator defined in claim 1, further comprising a digital display having at least two digits each formed by a plurality of digit segments each in turn connected to a respective one of said analog segments, and having a common digit connection, said means being connected to said common digit connection also for simultaneous energization thereof with energization of a plurality of said segment connections for optically activating some of said digit segments in a third phase and thereby indicating the second.

5. The indicator defined in claim 4, further comprising a connection ring connected to every other electrode connection and another connection ring connected to the remaining electrode connections, whereby the electrodes connected to the one ring alternate with the electrodes connected to said other ring.

6. The indicator defined in claim 5 wherein said one ring lies inside said arrays and said other ring lies outside said arrays.

7. The indicator defined in claim 4, wherein said analog segments include liquid-crystal material.

8. A chronometric indicator comprising:

an array of generally angularly equispaced electrodes each having a respective electrode connection;

an array of generally angularly equispaced analog display segments each having a respective segment connection and each having one half overlapping one respective electrode and and another half overlapping another respective electrode;

a multidigit display having at least two digits each formed by a plurality of digit segments each in turn connected to a respective one of said analog segments, and having a common digit connection, whereby simultaneous electrical energization of said common digit connection and one of said segment connections of an analog segment connected to a digit setment will optically activate the respective digit segment; and means connected to said connections for selectively energizing same and thereby optically activating said halves by simultaneous energization of the respective electrode and segment connections.

9. The indicator defined in claim 8 wherein said multidigit display lies within said arrays.

* * * * *